US007444832B2

(12) United States Patent
Görz et al.

(10) Patent No.: US 7,444,832 B2
(45) Date of Patent: Nov. 4, 2008

(54) COOLING APPLIANCE WITH CIRCULATED AIR COOLING AND COOLING AIR INJECTION

(75) Inventors: Alexander Görz, Aalen (DE); Hans Ihle, Giengen (DE); Matthew Ricket, New Bern, NC (US); Ralf Spiller, Giengen (DE); Martin Wagner, Nattheim (DE)

(73) Assignee: BSH Home Appllances Corporation, Huntington Beach, CA (US)

( * ) Notice: Subject to any disclaimer, the term of this patent is extended or adjusted under 35 U.S.C. 154(b) by 312 days.

(21) Appl. No.: 11/126,435

(22) Filed: May 10, 2005

(65) Prior Publication Data

US 2006/0254303 A1 Nov. 16, 2006

(51) Int. Cl.
*F25D 17/08* (2006.01)

(52) U.S. Cl. ..... 62/418; 454/305

(58) Field of Classification Search ..... 62/418, 62/407, 186, 408, 409; 454/305, 307, 333
See application file for complete search history.

(56) References Cited

U.S. PATENT DOCUMENTS 1,951,269 A * 3/1934 Boeckx et al. ..... 132/212
2,654,305 A * 10/1953 Robertson ..... 454/305
3,889,487 A * 6/1975 Frankfurt ..... 62/99
3,968,936 A * 7/1976 Bruhlmeier ..... 239/550
4,266,722 A * 5/1981 Nawa et al. ..... 239/590.5
4,270,694 A * 6/1981 Knauth ..... 236/49.3
5,520,580 A * 5/1996 Showalter et al. ..... 454/273
5,921,104 A * 7/1999 Chang ..... 62/407
5,953,929 A * 9/1999 Bauman et al. ..... 62/259.1
6,070,419 A * 6/2000 Chang ..... 62/89

FOREIGN PATENT DOCUMENTS

WO WO 2004038312 A1 * 5/2004
WO WO 2004092665 A1 * 10/2004

* cited by examiner

*Primary Examiner*—William E Tapolcai
(74) *Attorney, Agent, or Firm*—Russell W. Warnock; James E. Howard

(57) ABSTRACT

A cooling appliance (1) with circulated air cooling, comprising at least one cooling chamber (2) for reception of stock (3) to be cooled, at least one channel (4) for cooling air (5) and a coldness generator (12) for generating cooling air (5), wherein the channel (4) provides a fluid-conducting connection of the coldness generator (12) with the cooling chamber (2) and opens into the cooling chamber (2) by an outlet opening (6), wherein a jet forming means (7) is provided and wherein the jet forming means (7) is formed by a nozzle element (18) and/or by a spacer (10), by which the stock (3) to be cooled is kept at a spacing from the outlet opening (6), at the outlet opening (6). A precise, uniform and energy-saving temperature conditioning of the stock (3), which is to be cooled, in the cooling chamber (2) is made possible by the invention.

22 Claims, 2 Drawing Sheets

COOLING APPLIANCE WITH CIRCULATED AIR COOLING AND COOLING AIR INJECTION

FIELD OF THE INVENTION

The invention relates to a cooling appliance with circulated air cooling, comprising at least one cooling chamber for reception of stock to be cooled, at least one channel for cooling air and a coldness generator for generating cooling air, wherein the channel provides a fluid-conducting connection of the coldness generator with the cooling chamber and opens into the cooling chamber by an outlet opening.

BACKGROUND OF THE INVENTION

In appliances with circulated air cooling the cooling air cooled by a central evaporator and conveyed by a fan is conducted by a so-called multi-flow system into the storage chamber to be cooled in order to even out the temperature distribution in the storage chamber and to ensure adequate cooling even in the event of a high degree of occupancy of the storage chamber.

Circulated air cooling appliances and circulated air freezing appliances are known, which have storage compartments supplied with cooling air by means of an air channel arranged at the foam side. The side of the metallic internal container of the circulated air cooling appliance or circulated air freezing appliance associated with the storage container in that case remains smooth at the outset and the metallic internal container has one or more openings along the air channel at the foam side so that cooling air can flow out of the channel into the internal space of the circulated air cooling appliance or circulated air freezing appliance. The air expulsion openings themselves are so selected with respect to their number and size that adequate cooling can be ensured for the respective appliance.

However, in the case of the known solutions the cooling air does not always reach all regions of the internal space of the circulated air cooling appliance or circulated air freezing appliance. For this reason in the known solutions the temperature of the cooling air flowing into the cooling chamber has to be selected to be colder than necessary for sufficient cooling of the stock to be cooled, in order to guarantee that all the stock to be cooled and disposed in the cooling chamber is stored below a predetermined maximum temperature. As a consequence, the circulated air cooling appliance or circulated air freezing appliance is not optimally operated from the aspect of efficient utilization of energy.

BRIEF SUMMARY OF THE INVENTION

It is thus an object of the present invention to provide a cooling appliance with circulated air cooling which can be operated in the an energy-saving manner, whilst ensuring reliable cooling of the cooling stock to be cooled by the cooling appliance.

According to the invention this object is fulfilled by the cooling appliance indicated in the independent claim. Further advantageous refinements and developments, which in each instance can be used individually or combined with one another as desired, are the subject of the dependent claims.

The cooling appliance according to the invention with circulated air cooling comprises at least one cooling chamber for reception of stock to be cooled, at least one channel for cooling air and a coldness generator for generating cooling air, wherein the channel connects the coldness generator with the cooling chamber in fluid-conducting manner and opens into the cooling chamber by an outlet opening, wherein a jet forming means is provided and wherein the jet forming means is formed by a nozzle element and/or by a spacer—by which the stock to be cooled is kept at a spacing from the outlet opening—at the outlet opening.

By cooling appliance there is to be understood all cooling appliances with circulated air cooling, particularly also freezing appliances with circulated air cooling. In a modification of the invention there is also conceivable a transposition of the invention to circulated air ovens, wherein in correspondence with the conditions of a circulated air oven the cooling air is to be replaced by heating air, the stock to be cooled by oven stock, the cooling chamber by an oven chamber and the coldness generator by a heat generator.

Influencing of the cooling air flow issuing into the cooling chamber is made possible by the jet forming means. In particular, a cooling air flow is produced deep in the cooling chamber. Turbulence and eddies are thereby preferably avoided.

The cooling air flow is advantageously formed horizontally in the cooling chamber with the help of the jet forming means and runs, in particular, in a direction perpendicular to the cooling chamber inner surface within which the outlet opening is disposed.

The outlet opening can be disposed at the rear side of the cooling chamber, i.e. at the side opposite the door or flap of the cooling chamber. However, it can also be arranged at the side walls of the cooling chamber.

Advantageously, a plurality of outlet openings, particularly between 2 and 20, advantageously between 4 and 10, are provided in the inner surfaces of the cooling chamber in order to produce cooling of the stock, which is to be cooled, in the cooling chamber as uniformly as possible.

It is ensured with the help of a spacer that the stock to be cooled is kept at a spacing from the outlet opening so that closing off of the outlet opening is avoided. Dead spaces in the cooling chamber, which due to unfavorable positioning of the stock to be cooled in front of an outlet opening are inadequately supplied with cooling air, are avoided with the assistance of the spacer. A precise, uniform, rapid and reliable cooling of the stock to be cooled is also assisted by that.

Not only the nozzle element, but also the spacer contribute to evening out the temperature distribution in the cooling chamber, and reduction of the temperature of the cooling air in order to avoid exceeding a maximum temperature in a part area within the cooling chamber is no longer necessary. As a consequence, the cooling appliance can be operated in energy-saving manner. With the help of the invention it is possible to maintain very small temperature fluctuation tolerances even in the case of substantial changes in load, i.e. in the case of frequent opening of the cooling chamber door or in the case of a strongly variable quantity of stock to be cooled in the cooling chamber. Through the stronger temperature coupling, which is produced by the jet forming means, between stock to be cooled and coldness generator the actually required quantity of cold can be made available by the coldness generator more precisely.

In an embodiment the jet forming means is formed by a narrowing section in the outlet opening, by which a cross-section of the channel in the outlet opening is substantially smoothly reduced towards the cooling chamber, wherein, in particular, the cross-section of the channel is reduced by at least 20%, preferably by at least 30% and particularly preferably by at least 40%.

A nozzle effect enabling a particularly stable flow of the cooling air in the interior of the cooling chamber is achieved by the narrowing section. An injection of the cooling air which is favorable from the hydrodynamic aspect is possible through the substantially smooth reduction of the cross-section. Through the smooth—i.e. free as possible of steps and edges—reduction there is avoidance of eddies and turbulence which otherwise lead to instability of the flow and obstruct flow of the cooling air into deeper regions of the cooling chamber.

The jet forming means can have a convexity along which the cooling air is conducted into the cooling chamber. The convexity can be formed at only one side or at several sides of the outlet opening, wherein advantageously the convexity is arranged at the upper side of the outlet opening.

The inner side of the jet forming means facing the outlet opening can be formed in such a manner that it describes an as large as possible radius at the side of the inflowing air. The cooling air flowing in the channel seeks to follow this convexity in correspondence with the laws of flow mechanics and issue from the outlet opening. It is thus not necessary to introduce a barrier stage for raising a velocity head and turbulence is avoided, whereby there is less disruption of the flow conditions in the entire system and the efficiency of the cooling appliance is improved.

Advantageously the radius of the convexity amounts to at least 5 millimeters, particularly at least 10 millimeters, preferably at least 20 millimeters, particularly preferably at least 30 millimeters, and/or is less than 200 millimeters, particularly less than 100 millimeters, preferably less than 50 millimeters. The flow conditions in the cooling chamber are advantageously influenced by formation of the jet forming means in that manner.

In a special form of embodiment of the invention the jet forming means extends into the cooling chamber by an overhang of at least 10 millimeters, particularly at least 15 millimeters, preferably at least 20 millimeters. Changing of the outlet opening by stock to be cooled is largely avoided by this overhang and the cooling air can flow in through the intermediate space between an inner wall of the cooling chamber and the stock to be cooled without creation of an excessive flow resistance by the stock to be cooled. Thus, even in this region of the cooling chamber a sufficiently large flow of cooling air is provided and there is avoidance of an inadequately cooled part space.

A combination of the cooling air injection with the spacer is particularly advantageous, since the constructional depth required for a greatest possible radius of the convexity can be utilized for the purpose of employing the jet forming means not only for producing a particularly deep volume flow, but also for ensuring a cooling air flow.

Advantageously, the jet forming means is formed by a spacer edge which is arranged above with respect to the outlet opening and which protrudes beyond an outlet edge, which is below with respect to the outlet opening, of the outlet opening. Thus, a minimum expulsion cross-section remains even when storage stock is pushed directly against the outlet opening.

The jet forming means can be provided at an inner side of the cooling chamber. However, it can also be integrated in a wall of the cooling chamber, wherein it can protrude partly beyond the inner side of the cooling chamber.

Advantageously the jet forming means is arranged substantially above the outlet opening. A protrusion is advantageous as overhang, since penetration of condensation water or dirt into the channel is thereby avoided.

The jet forming means can be wider than the width of the channel and/or its height somewhat larger than the outlet opening of the channel. In a special embodiment of the invention the jet forming means extends over at least ⅓ of the internal area of the cooling chamber, particularly over at least half the internal width of the cooling chamber, or over the entire width of the cooling chamber. Advantageously an intermediate space between stock to be cooled and inner wall of the cooling chamber is thereby created even when the entire internal width of the cooling chamber is cluttered by stock to be cooled.

It is of advantage if the jet forming means can be placed on at an inner side of the cooling chamber. Through, in particular, the capability of being placed on it is possible to retrofit known cooling appliances, whereby the cooling efficiency thereof or cooling characteristics of these appliances as well can be improved.

The jet forming means advantageously comprises adhesive surfaces and/or detent elements by which it is fastened to the inner side of the cooling chamber. Detent lugs or detent projections can be used as detent elements. They can advantageously be capable of being clipped on.

In a special embodiment of the invention the channel is led along a side of the cooling chamber and opens angularly into the cooling chamber. This embodiment is advantageous particularly when the coldness generator is disposed entirely at the bottom or entirely at the top of the cooling appliance and the channel therefrom has to be led along a side of the cooling chamber.

The jet forming means is advantageously formed by injection molding.

BRIEF DESCRIPTION OF THE DRAWINGS

Particular details and further advantages are explained in more detail by reference to the following drawings, which are to illustrate the invention not restrictively, but merely by way of example, wherein there is shown schematically in.

DETAILED DESCRIPTION OF THE INVENTION

Figure 1:
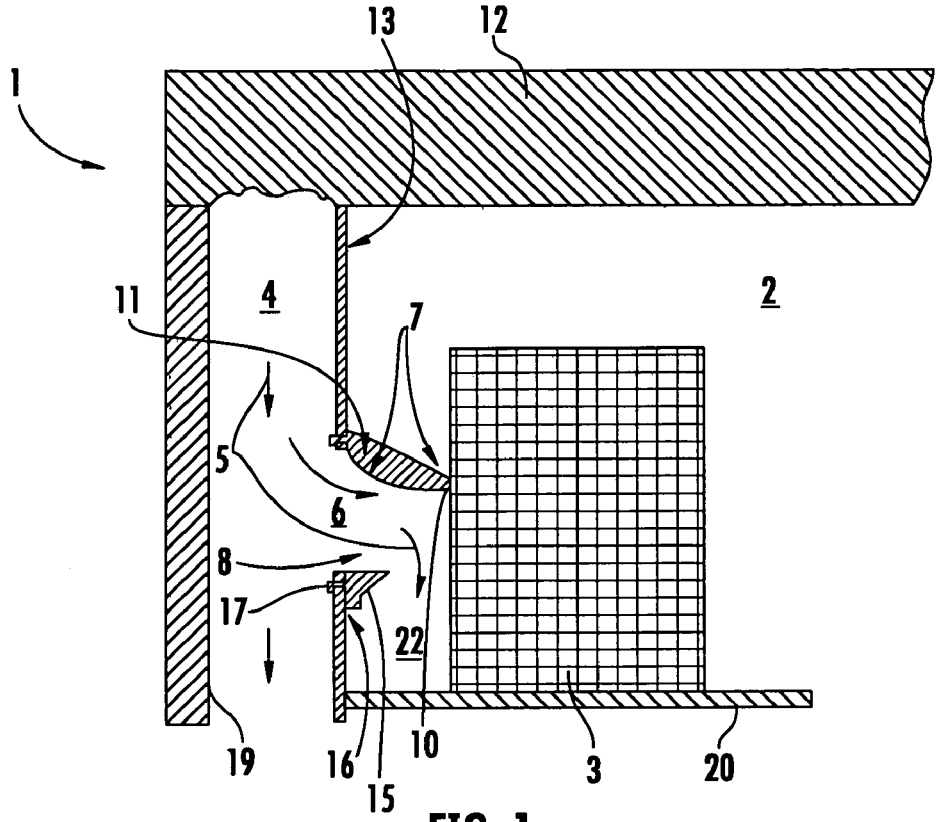
FIG. 1 a detail of a cooling appliance according to the invention, in a sectional view from the side, FIG. 2 a detail of a cooling appliances according to the invention, in a front view, and FIG. 3 a jet forming means in a sectional view from the side, as can be used for the cooling appliance according to the invention in accordance with FIG. 2.

FIG. 1 shows a detail of a cooling appliance 1 according to the invention in a sectional view from the side, with a cooling chamber 2 for reception of stock 3 to be cooled, the stock being cooled with the help of cooling air 5 provided by a coldness generator 12 via a channel 4. The coldness generator 12 is disposed above the cooling chamber 2. The cooling air 5 is conducted into the cooling chamber 2 by way of a outlet opening 6 as shown by the arrows in the figure, wherein a jet forming means 7 positively influences the flow of the cooling air. The jet forming means 7 produces an injection of the cooling air 5 into the cooling chamber 2. In the illustrated example the stock 3 to be cooled is disposed directly in front of the outlet opening 6. In this combination a nozzle effect of the jet forming means 7 cannot, in fact, be achieved, but the function of the jet forming means 7 as a spacer 10 comes into being. The cooling air flows into an intermediate space 22 formed between a spacer edge 14 (see FIG. 3) and an outlet edge 15 due to a corresponding spacing of the stock 3, which is to be cooled, from an inner side 13 of the cooling chamber. The inner side 13 of the cooling chamber 2 is disposed at a rear side of the cooling chamber 2, i.e. at the side opposite a door (not illustrated) of the cooling chamber 2. The stock 3 to be cooled stands on a support grid 20 permeable by the cooling air 5 so that notwithstanding obstruction of the outlet opening 6 an inflow of cooling air 5 is possible without appreciable increase in the flow resistance. The jet forming means 7 has at the upper inner side thereof a convexity 11 along which the cooling air flows in. The convexity has a radius of 3 centimeters and leads, by way of its nozzle effect, to a flow extending far into the interior of the cooling chamber 2 insofar as no stock 3 to be cooled is obstructively disposed in the way.

With the jet-concentrating characteristic or jet-focusing characteristic of the jet forming means a flow of the cooling air deep into the cooling chamber is produced even when stock to be cooled is disposed at a certain distance, since due to the jet concentration a comparatively good reflection or deflection of the flow by the stock to be cooled is made possible, so that the cooling air reaches even regions in the cooling chamber 2 disposed at a greater distance. Advantageously the speed of the cooling air at a spacing of 20 centimeters from the outlet opening reduces by less than 50%, especially less than 30%, preferably less than 15%, of the speed at which the cooling air 5 issues from the outlet opening 6.

The jet forming means 7 is advantageously fastened to the inner side 13 of the cooling chamber 2 with the help of detent elements 17, wherein additional adhesive surfaces 16 ensure further retention. The detent elements 17 can be constructed as detent lugs which can be clipped into corresponding receptacles (not illustrated) at the inner side 13. The channel 4 runs at a rear side 19 of the cooling chamber 2 and the cooling air 5 is conducted into the cooling chamber 2 by way of a plurality of outlet openings 6. The convexity 11 forms a tapering section 8 which represents a nozzle element 18.

Figure 2:
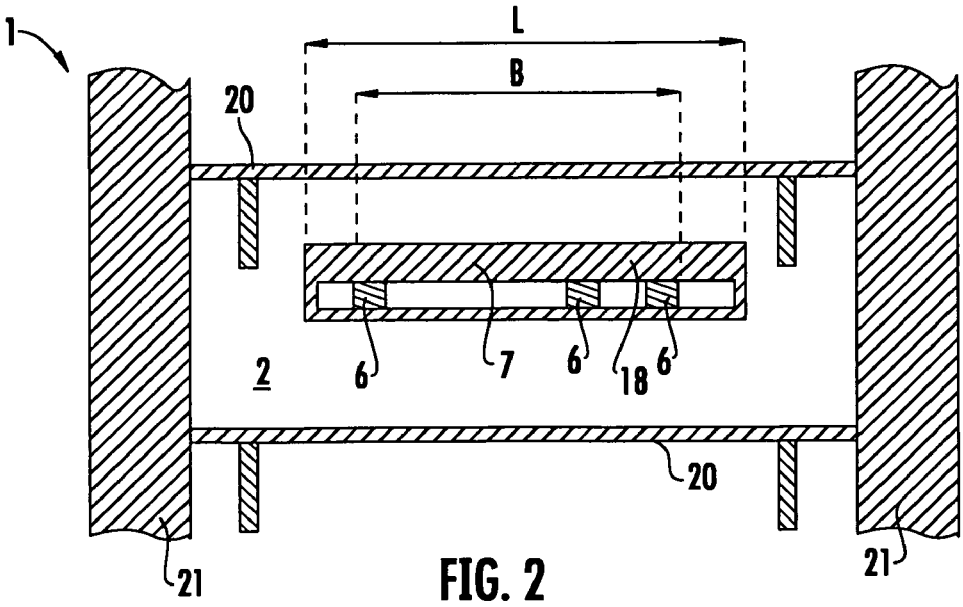

FIG. 2 shows a detail of a cooling appliance 1 according to the invention from the front with support grids 20 for reception of stock (not illustrated) to be cooled. The cooling chamber 2 has a plurality of outlet openings 6 at which a jet forming means 7 is arranged. The jet forming means 7 has a nozzle element 18 by which the cooling air 5 is injected far into the interior of the cooling chamber 2. The jet forming means 7 has a length L which is greater than a width B of the channel 4. The length of the jet forming means extends over approximately 70% of the width of the cooling chamber 2, which is bounded by side walls 21.

Figure 3:
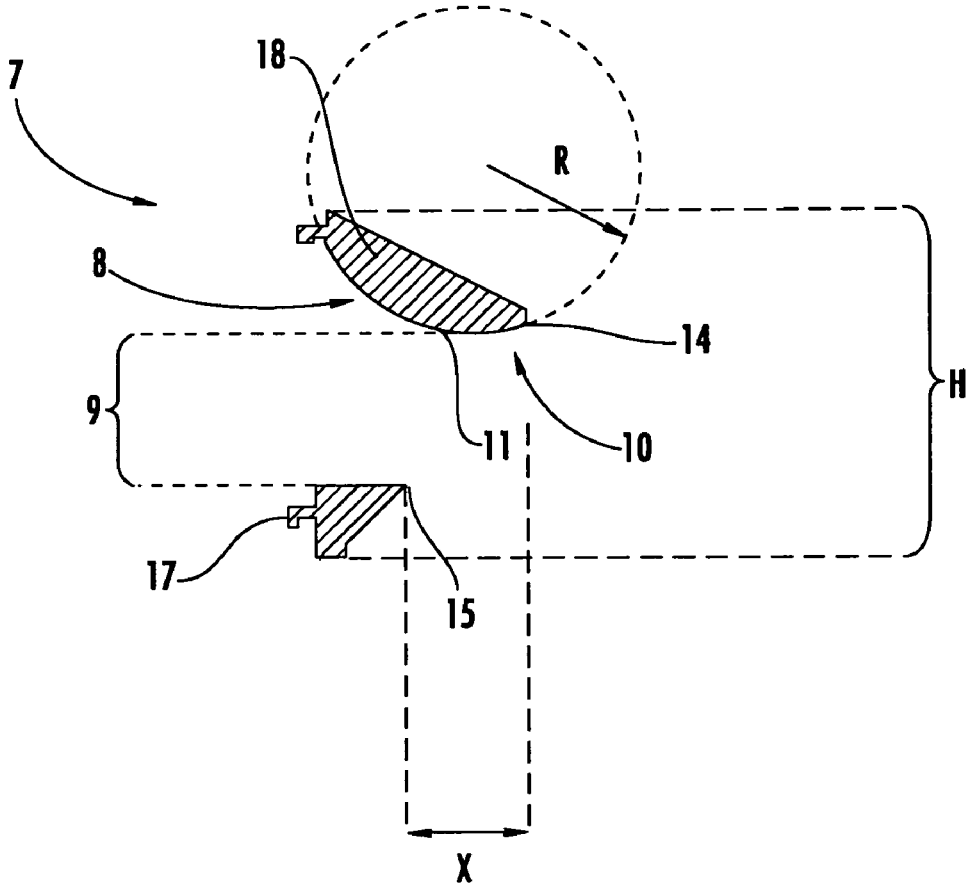

FIG. 3 shows the jet forming means 7 of FIG. 2 in a sectional view from the side and has a height H which is greater than the height of an outlet opening 6. The jet forming means 7 has a nozzle element 18 containing a convexity 11, which achieves a nozzle effect. The convexity 11 has a radius R of 30 millimeters. The jet forming means 7 can be fastened with the help of detent elements 17. The jet forming means 7 is formed by a tapering section 8 having a reduction of the cross-section 9 of the channel 4 by 25%. A spacer edge 14 and an outlet edge 15 produce a spacer function so that cooling air 5 can issue even when stock 3 to be cooled is arranged directly in front of an outlet opening 6. The spacer edge 14 protrudes by an overhang X beyond the outlet edge 15 so that issue of cooling air 5 is possible even when stock 3 to be cooled is placed in front. The height H of the jet forming means 7 is higher than the outlet opening 6.

The invention relates to a cooling appliance 1 with circulated air cooling, comprising at least one cooling chamber 2 for reception of stock 3 to be cooled, at least one channel 4 for cooling air 5 and a coldness generator 12 for producing cooling air 5, wherein the channel 4 connects the coldness generator 12 with the cooling chamber 2 in fluid-conducting manner and opens into the cooling chamber 2 by an outlet opening, wherein a jet forming means 7 is provided and wherein the jet forming means 7 is formed by a nozzle element 18 and/or by a spacer 10 at the outlet opening 6, through which the stock 3 to be cooled is kept at a spacing from the outlet opening 6. A uniform, precise and energy-saving temperature-conditioning of the stock 3, which is to be cooled, in the cooling chamber 2, is made possible by the invention.

REFERENCE NUMERAL LIST

1 cooling appliance
2 cooling chamber
3 stock to be cooled
4 channel
5 cooling air
6 outlet opening
7 jet forming means
8 narrowing section
9 cross-section
10 spacer
11 convexity
12 coldness generator
13 inner side of the cooling chamber 2
14 spacer edge
15 outlet edge
16 adhesive surfaces
17 detent elements
18 nozzle element
19 side of the cooling chamber 2
20 support grid
21 side wall of the cooling chamber 2
22 intermediate space
R radius
L length of the jet forming means 7
B width B of the channel 4
H height of the jet forming means 7
X overhang

What is claimed is:

1. A cooling appliance with circulated air cooling comprising:

at least one cooling chamber for receiving stock to be cooled;

at least one channel for cooling air in fluid communication with the cooling chamber;

a coldness generator for generating cooling air, wherein the channel provides a fluid-conducting connection of the coldness generator with the cooling chamber and opens into the cooling chamber by an outlet opening; and a jet forming element comprising a nozzle element and a spacer, the jet forming element being adjacent to the outlet opening, wherein the spacer projects into the cooling chamber such that the stock to be cooled is kept at a spacing from the outlet opening.

2. The cooling appliance according to claim 1, wherein the jet forming element produces a narrowing of the outlet opening, by which a cross-section of the channel is substantially smoothly reduced in the outlet opening towards the cooling chamber, wherein the cross-section of the channel is reduced by at least 20%.

3. The cooling appliance according to claim 2, wherein the cross-section of the channel is reduced by at least 30%.

4. The cooling appliance according to claim 2, wherein the cross-section of the channel is reduced by at least 40%.

5. The cooling appliance according to claim 1, wherein the jet forming element has a convexity along which the cooling air is conducted into the cooling chamber.

6. The cooling appliance according to claim 5, wherein the radius of the convexity is at least 5 millimeters and smaller than 200 millimeters.

7. The cooling appliance according to claim 5, wherein the radius of the convexity is at least 10 millimeters and smaller than 100 millimeters.

8. The cooling appliance according to claim 5, wherein the radius of the convexity is at least 30 millimeters and smaller than 50 millimeters.

9. The cooling appliance according to claim 1, wherein the jet forming element extends into the cooling chamber by an overhang of a selected one of at least 10 millimeters, at least 15 millimeters, and at least 20 millimeters.

10. The cooling appliance according to claim 1, wherein the jet forming element is arranged at the top with respect to the outlet opening and projects beyond an outlet edge of the outlet opening, the outlet edge being arranged at the bottom with respect to the outlet opening.

11. The cooling appliance according to claim 1, wherein the jet forming element is provided at an inner side of the cooling chamber.

12. The cooling appliance according to claim 1, wherein the jet forming element is arranged substantially above the outlet opening.

13. The cooling appliance according to claim 1, wherein the jet forming element is wider than the width of the channel and the height is larger than the outlet opening of the channel.

14. The cooling appliance according to claim 13, wherein the jet forming element extends over a selected one of at least a third of the internal width of the cooling chamber, at least half the internal width of the cooling chamber, and the entire internal width of the cooling chamber.

15. The cooling appliance according claim 1, wherein the jet forming element is placed on an inner side of the cooling chamber.

16. The cooling appliance according to claim 1, wherein the jet forming element has at least one of adhesive surfaces and detent elements by which it is fastenable to an inner side of the cooling chamber.

17. The cooling appliance according to claim 1, wherein the channel is led along a side of the cooling chamber and opens at an angle into the cooling chamber.

18. A cooling appliance with circulated air cooling comprising:

a cooling chamber for receiving a stocked item to be cooled, the cooling chamber having a support surface on which stock to be cooled is supported and having a stand off surface;

a coldness generator for generating cooling air;

a channel for guiding cooling air, the channel being in fluid communication with the cooling chamber and with the coldness generator for guiding cooling air from the coldness generator to the cooling chamber, the channel has an outlet at the cooling chamber, whereupon cooling air is considered to have exited the channel once such cooling air flows beyond the outlet; and a contact location located at a spacing from the stand-off surface as viewed in a stand off direction, the contact location being located for intercepting stacked items supported on the support surface to resist any movement of such stocked items in the direction opposite to the stand off direction that would move such stocked items closer to the stand-off surface, and at least one portion of the outlet being at a lesser spacing from the stand-off surface as viewed in the stand-off direction than the contact location, wherein a stacked item supported on the support surface cannot be positioned in contact with the at least one portion of the outlet in that the contact location will intercept first any stocked item being moved in the direction opposite to the stand off direction and a gap extending in the stand off direction will exist between the at least one portion of the end periphery of the outlet and the stocked item, and the at least one portion of the outlet being at a height intermediate a height of a stocked item intercepted by the contact location and the support surface, whereupon the cooling appliance ensures that, in any position of a stocked item on the support surface both out of contact with the contact location and in contact with the contact location, cooling air can always pass beyond the outlet of the channel and into the gap extending in the stand off direction between the at least one portion of the outlet and the stocked item.

19. The cooling appliance according to claim 18, wherein the contact location is at a height intermediate a height of a stocked item intercepted by the contact location and the support surface.

20. The cooling appliance according to claim 18, wherein the outlet of the channel includes another portion and the another portion of the outlet forms the contact location.

21. The cooling appliance according to claim 20, wherein the another portion of the outlet forming the contact location has a convexity along which the cooling air is conducted into the cooling chamber.

22. The cooling appliance according to claim 20, wherein the another portion of the outlet forming the contact location has at least one of adhesive surfaces and detent elements by which it is fastenable to the stand-off surface.

* * * * *